US006207594B1

(12) United States Patent
Elgarhy

(10) Patent No.: US 6,207,594 B1
(45) Date of Patent: Mar. 27, 2001

(54) POLYAMIDE SUBSTRATE HAVING STAIN RESISTANCE, COMPOSITION AND METHOD

(75) Inventor: Yassin M. Elgarhy, Laval (CA)

(73) Assignee: Trichromatic Carpet Inc., St-Eustache (CA)

( * ) Notice: Subject to any disclaimer, the term of this patent is extended or adjusted under 35 U.S.C. 154(b) by 0 days.

(21) Appl. No.: 09/228,255

(22) Filed: Jan. 11, 1999

(51) Int. Cl.[7] ..... B32B 27/02; B32B 27/04; B32B 27/12; B04H 1/00

(52) U.S. Cl. ..... 442/93; 442/168; 442/414

(58) Field of Search ..... 442/414, 168, 442/93, 71; 428/224; 526/238.2, 322; 525/179; 427/329.4

(56) References Cited

U.S. PATENT DOCUMENTS 4,081,383 * 3/1978 Warbuton, Jr. et al. ..... 252/8.6
4,226,754 * 10/1980 Yun et al. ..... 260/29.6
4,526,581 7/1985 Prentiss et al. .
4,822,373 4/1989 Olson et al. .
4,937,123 6/1990 Chang et al. .
4,940,757 7/1990 Moss, III et al. .
5,015,259 5/1991 Moss, III et al. .
5,061,763 10/1991 Moss, III et al. .
5,223,340 6/1993 Moss, III et al. .
5,248,749 * 9/1993 Satoshi et al. ..... 526/322
5,356,689 10/1994 Pechhold .
5,451,642 * 9/1995 Abe et al. ..... 525/179
5,542,951 * 8/1996 Antwerpen et al. ..... 8/137
5,549,963 * 8/1996 Elgarhy et al. ..... 428/224
5,672,674 9/1997 Klaus et al. .
5,744,201 * 4/1998 Chang et al. ..... 427/393.4
5,977,275 * 11/1999 Rodrigues et al. ..... 526/238.2
6,001,343 * 12/1999 Trinh et al. ..... 424/76.4

* cited by examiner

*Primary Examiner*—Blaine Copenheaver
*Assistant Examiner*—Christopher C. Pratt
(74) *Attorney, Agent, or Firm*—Swabey Ogilvy Renault

(57) ABSTRACT

A combination of a semi-soluble or insoluble ethylmethacrylate polymer and a soluble or semi-soluble methacrylic acid polymer, optionally with a partially sulfonated resol resin which provides improved resistance to staining by acid colorants in a fibrous polyamide substrate.

22 Claims, No Drawings

POLYAMIDE SUBSTRATE HAVING STAIN RESISTANCE, COMPOSITION AND METHOD

BACKGROUND OF THE INVENTION

1. Field of the Invention

This invention relates to a fibrous polyamide substrate having durable resistance to staining by acid colorants and to a method of rendering a fibrous polyamide substrate durably resistant to staining by acid colorants.

2. Description of Prior Art

Fibrous polyamide substrates, such as nylon carpeting are susceptible to staining by both naturally occurring and commercial acid colorants found in many common foods and beverages. The demand for reduced staining from such acid colorants has by and large been met previously by treatment with compositions comprising sulfonated napthol and or phenol or sulfonated phenol-formaldehyde condensation products as disclosed for example in the following patents: U.S. Pat. No. 4,501,591, Ucci and Blyth; U.S. Pat. No. 4,592,940, Blyth and Ucci; U.S. Pat. No. 4,680,212, Blyth and Ucci; U.S. Pat. No. 4,780,099, Creshler, Malone and Zinnato; and U.S. Pat. No. 4,865,885, Herlant and Al, or by treatment with compositions comprising sulfonated novalak resins together with polymethacrylic acid as disclosed in U.S. Pat. No. 4,822,373 (Olson, Chang and Muggli). The use of polymers or copolymers of methacrylic acid of low weight average molecular weight and low number average molecular weight is described in U.S. Pat. No. 4,937,123 (Chang, Olson and Muggli).

The initial stain resistance properties imparted to polyamide substrates, such as carpeting, that have been treated using the above mentioned compositions degenerate significantly with each wet cleaning the substrate receives. Improved stain resistance after wet cleaning can be achieved by increasing the amount of the phenolic resin in the stain resist product or by increasing the amount of stain-resist product initially applied to the substrate, however, this generally leads to discoloration caused by yellowing of the substrate initially and further discoloration upon exposure to oxides of nitrogen and/or light. This discoloration in most cases is attributed to dihydroxydiphenol sulfone and its associated $SO_2$ group.

Stain resist products currently available in the market place are generally novalak—type resins based on dihydroxydiphenyl sulfone and phenol sulfonic acid condensed with aldehyde in acid media, or dihydroxy diphenyl sulfone and naphthalene sulfonic acid condensed with aldehyde at low pH.

It is generally known that increasing the ratio of dihydroxydiphenyl sulfone to the phenol sulfonic acid or napththalene sulfonic acid increases the stain resistance properties of the resin and subsequently causes a higher degree of yellowing or discoloration initially and further discoloration upon exposure to oxides of nitrogen and/or light.

It is also evident that when the ratio of phenol sulfonic acid or naphthalene sulfonic acid to dihydroxydiphenyl sulfone increases, the result is lower stain-resist properties and less discoloration.

The addition of acrylic polymers and/or copolymers to the previously mentioned novalak resin condensation products as disclosed in U.S. Pat. No. 4,822,373 (Olson, Chang and Muggli) allows the use of a novalak resin in small quantities and larger quantities of the acrylic resin. With this combination of novalak resin and acrylic resin, big improvement in the light fastness or less discoloration is achieved due to the dramatically reduced percentage of novalak resin in the product mentioned above which is adjusted to obtain a desired minimum level of discoloration while maintaining a maximum level of durability to wash. The high level of initial stain resistance is supplied primarily by the methylacrylic polymer and/or copolymer and after wet cleaning the stain resistance is supposedly maintained by the novalak resin, the acrylic having largely been removed during the wet cleaning process.

SUMMARY OF THE INVENTION

It is an object of this invention to provide fibrous polyamide substrates having durable resistance to staining by acid colorants.

It is a further object of this invention to provide a method of rendering a fibrous polyamide substrate durably resistant to staining by acid colorants.

It is a particular object of this invention to provide such a substrate or method in which a treating solution is employed which contains a combination of semi-soluble or insoluble and insoluble acrylic resins particularly of high weight average and number average molecular weight, to produce high stain resistance and durability to wet cleaning process to reduce the need for phenolic resin or to eliminate it completely, and to provide an optimum light fastness and minimum discoloration of the polyamide substrate due to nitrogen oxides or light.

In accordance with one aspect of the invention there is provided a fibrous polyamide substrate having resistance to staining by acid colorants, said fibrous polyamide substrate having applied thereto a combination of:

a) a semi-soluble or insoluble ethyl methacrylate polymer; and b) a soluble or semi-soluble methacrylic acid polymer.

In accordance with another aspect of the invention there is provided an aqueous formulation for providing resistance to staining by acid colorants in fibrous polyamide substrates comprising:

a) a semi-soluble or insoluble ethyl methacrylate polymer, and b) a soluble or semi-soluble methacrylic acid polymer, and c) an aqueous vehicle for said polymer.

In accordance with still another aspect of the invention there is provided a method of imparting stain resistance to acid colorants, to a fibrous polyamide substrate comprising contacting said fibrous polyamide substrate with an aqueous formulation comprising in an aqueous vehicle a) a semi-soluble or insoluble ethylmethylacrylate polymer, and b) a soluble or semi-soluble methacrylic acid polymer.

Preferably polymers a) and b) are both of high molecular weight.

DETAILED DESCRIPTION OF THE INVENTION

In accordance with the invention, it has been found that completely soluble acrylic and methacrylic homopolymers and copolymers do not have durability to wet cleaning, so that their stain resist effect diminishes with wet cleaning; whereas completely insoluble acrylic resins have very little or no stain resist effect on polyamide fibers.

The present invention employs a combination of two or more acrylic resins, one of which has sufficient solubility and the other sufficient insolubility, so that in combination there is a synergetic effect between the resins and polyamide fibers of a polyamide substrate and the resins are resistant to wet cleaning processes, thereby providing durable stain resistance, the combination also provides initial stain resistance, prior to wet cleaning of the polyamide fiber substrate as well as a soil release effect.

The combination improves the light fastness and reduces the discoloration or yellowing caused by heat nitrogen oxides or light.

Suitably the semi-soluble or insoluble ethyl methacrylate polymer component a) is a homopolymer of ethylmethacrylate or a copolymer of ethylmethacrylate and at least one comonomer, for example, ethylacrylate, methylacrylate, methylmethacrylate, methacrylic acid, butylmethacrylate, isobutyl methacrylate or 2-ethylhexylmethacrylate. An especially preferred comonomer is methacrylic acid.

The ethyl methylacrylate polymer a) suitably has a high weight average molecular weight of at least 100,000 to 500,000, and preferably 100,000 to 250,000, and more preferably 100,000 to 170,000, and a high number average molecular weight of at least 25,000 to 100,000, preferably 35,000 to 75,000, and more preferably 30,000 to 60,000.

The soluble or semi-soluble methacrylic acid polymer component b), is suitably a homopolymer of methacrylic acid or a copolymer of methacrylic acid and at least one comonomer, for example, ethylacrylate, 2-ethylhexylmethacrylate, ethylmethacrylate, methylmethacrylate, butyl methacrylate or isobutyl methacrylate.

The methacrylic acid polymer b) suitably has a high weight average molecular weight of at least 100,000, typically 100,000 to 500,000, and preferably 150,000 to 250,000, more preferably over 200,000; and a high number average molecular weight of at least 40,000, typically 50,000 to 100,000, and preferably 50,000 to 85,000, and more preferably 60,000 to 75,000.

The resin combination of the invention may optionally include a partially sulfonated resol resin.

The ethyl methacrylate polymer a) and the methacrylic acid polymer b) together with the partially sulfonated resol resin, if employed, are applied to the polyamide fiber substrate in an aqueous vehicle in which the polymers and resin are mixed in water.

An aqueous formulation of the polymers and resol resin, if present, for treating a polyamide fiber substrate, typically contains an amount of ethylmethacrylate polymer a) and methacrylic acid polymer b) to deposit an amount on polyamide fiber substrate of Nylon 66 of at least 0.1 wt % and at least 0.4 wt % of Nylon 6.

Suitable partially sulfonated resol resins are known and are described in U.S. Pat. Nos. 5,457,259; 5,549,963; 5,736,468 and 5,756,407, the teachings of which are incorporated herein by reference. The resol resin, when employed, is preferably in the aqueous formulation in a concentration effective to deposit an amount on the polyamide fiber substrate of at least 0.1 wt. % on Nylon 6 and at least 0.03 wt. % on Nylon 66, based on the weight of the substrate. Suitably the resole resin when employed provides an amount up to 4 wt. %.

More especially when the substrate is Nylon 66, the partially sulfonated resin is present in an amount up to 2%, by weight, and thus in a range of 0 to 2%, by weight; ethylmethacrylate polymer a) is preferably present in an amount of at least 0.02%, by weight; and methacrylic acid polymer b) is preferably present in an amount of at least 0.04%, by weight, all based on the weight of substrate.

On the other hand, when the substrate is Nylon 6 the partially sulfonated resin is more especially present in an amount of up to 4%, by weight, and thus in the range of 0 to 4%, by weight, ethylmethacrylate polymer is preferably present in an amount of at least 0.04%, by weight; and methacrylic acid polymer b) is preferably present in an amount of at least 0.08%, by weight, all based on the weight of the substrate.

The amounts of the polymers and resol resin deposited from the aqueous formulation and the polyamide fiber substrate is dependent on the process employed for the deposition, as is well understood by persons in the art, and thus persons in the art will well understand the concentrations required in the aqueous formulation, based on the application technique and method parameters employed.

The aqueous formulation is applied to the fibrous substrate by conventional procedures, for example, the substrate may be immersed in a bath of the aqueous formulation, or the formulation may be exhausted onto the substrate. Suitably, the treated substrate is rinsed with water and dried. The treated substrate retains the deposited polymers and resol resin if present.

TEST METHODS

In the test procedures and examples described below all percentages are by weight unless otherwise indicated, the molecular weight (M.W.) is the weight average molecular weight, and the molecular weight (M.N.) is the number average molecular weight.

Initial Stain Resistance ("IS")

A 5"×5" sample of the substrate to be tested is placed on a flat, non-absorbent surface. A two inch ring is placed on the sample and 20 ml of staining solution is poured into the ring and worked into the substrate. The ring is removed and the sample is left undisturbed for 24 hours at ambient temperature. The staining solution is prepared by dissolving 0.6 gr of cherry flavoured KOOLAID (Trade-mark), which contains Acid Red Dye No. 40 in 1000 grs of water then the pH of the solution is adjusted to pH 5 with citric acid, the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8=EXCELLENT STAIN RESISTANCE
7=GOOD STAIN RESISTANCE
6=POOR STAIN RESISTANCE
5=UNACCEPTABLE STAINING
4=UNACCEPTABLE STAINING
3=UNACCEPTABLE STAINING
2=UNACCEPTABLE STAINING
1=UNACCEPTABLE STAINING

After Wet Cleaning Stain Resistance ("W.S.")

The sample to be tested is first immersed in a detergent solution containing 5 g/L sodium lauryl sulfate 30% solid and the pH of the solution is adjusted to pH 10 with T.S.P. (Trisodium phosphate) the sample stands in the solution for 15 minutes at 20° C. The sample is removed from the detergent solution and rinsed thoroughly with cool tap water and dried. The staining solution is then applied and evaluated as set out in the initial stain resistance procedure.

Initial Yellowing (Discoloration) Evaluation ("ID")

In the Examples a graduated scale from 1 to 5 was used to evaluate yellowing where 5 represents no yellowing, 4 represents acceptable yellowing and 3 or less represents unacceptable yellowing.

Discoloration Upon Exposure to Light ("LD")

In the examples a graduated scale from 1 to 5 was used to evaluate discoloration upon exposure to light where 5 represents no discoloration, 4 represents acceptable discoloration and 3 or less represents unacceptable discoloration. Exposure to light was carried out according to AATCC test method 16E with an exposure time of 80 standard hours.

DESCRIPTION OF PREFERRED EMBODIMENTS

Acrylic A)

In a clean reaction vessel equipped with mechanical stirrer to produce efficient agitation the following were charged as mix #1: 85.8 parts water and 2.2 parts ammonium persulfate.

The above solution was heated to 80° C. and maintained at this temperature.

In a separate tank the following were charged as mix #2:
0.7 ethyl acrylate
3.52 parts methyl methacrylate
6.6 parts methacrylic acid
45 parts water
26.4 parts ethyl methacrylate
3.52 parts dodecyl benzene sulfonic acid sodium salt;
a further addition of 1 to 5 parts ammonium persulfate to obtain the desired mole weight.

Mix #2 was added slowly to mix #1 while maintaining the temperature at 80° C. After the last addition, the reaction continued for 90–120 minutes at 80–90° C., whereafter the reaction mixture was allowed to cool to 30° C. The reaction produced an anionic milky emulsion with approximately 25 to 26%, by weight, solid content. The resultant ethylmethacrylate copolymer had a weight average molecular weight of 110,000, and a number average molecular weight of 36,000, and is referred to in the Examples as acrylic copolymer A.

Acrylic B)

In a clean reactor vessel the following were added:
Mix #1

92.36 parts by weight of water and 0.14 parts by weight of ammonium persulfate.

The solution was heated to 90° C. and maintained at this temperature at all times with continued agitation.
Mix #2

In a separate tank the following were added in parts by weight.

57.2 parts water, 29.6 parts methacrylic acid, 1.85 parts of 2 ethyl hexyl methacrylate, 1.85 parts of dodecyl benzene sulfonic acid sodium salt (30% solid), and a final addition of 0.1 to 0.7 parts ammonium persulfate to obtain the desired mole weight.

Mix #2 was added slowly to mix #1 while maintaining the temperature at 90° C. at all times, after the last addition the temperature was raised to 95° C. and the reaction continued for 90 minutes, whereafter the reaction mixture was allowed to cool to 30° C.

The above reaction resulted in an anionic hazy solution with high viscosity and a solid content of 17%–18%, by weight, solids.

The resultant methacrylic acid copolymer had a weight average molecular weight of 209,000, and a number average molecular weight of 70,000, and is referred to in the Examples as acrylic copolymer B.

Acrylic C)

In a clean reactor vessel the following were added:

69.8 water 0.11 sodium persulfate

The solution was heated to 90° C. and maintained at this temperature at all time with continued agitation.
Mix 2

In a separate tank the following were added in parts by weight:

4.2 ethyl methacrylate 16.8 methacrylic acid 0.05 to 0.5 sodium persulfate to obtain the mole weight required and 49 parts water.

Mix 2 was added slowly to mix 1 while maintaining the temperature at 80° C. After the last addition, the reaction continued for 90 minutes at 80–90° C. whereafter the reaction mixture was allowed to cool at 30° C.

The reaction produced an anionic milky emulsion with 21 to 22 wt. % solids, the ethylmethacrylate copolymer had a weight average molecular weight of 225,000 and a number average molecular weight of 73,000 and is referred to in the Examples as acrylic polymer C.

The acrylic copolymers A and B in combination and B and C in combination were compared to Leukotan 970 (trademark available from Rohm and Haas) and also compared to a combination of Leukotan 970 at 32%, by weight, solids and a phenolic resin available under the trade-mark Alguard NS from Allied Colloid at 40%, by weight, solids.

The mentioned products were tested as follows.

EXAMPLES

Example 1

1. Test on Nylon 6

The treatment bath was adjusted to pH2 with sulfamic acid, and 3 g/L magnesium sulfate was added whenever phenolic resin was included, to each bath. The amount of stainblocker used was as follows:

Sample A 13.0 g/L of acrylic copolymer B and 3 g/L acrylic copolymer A
Sample B 16 g/L of Leukotan 970
Sample C 10 g/L of Leukotan 970
Sample D 13 g/L of Leukotan 970, and 3.0 g/L Alguard NS
Sample E 12.5 g/L acrylic copolymer B and 2.5 acrylic copolymer A and 2.0 g/L resol resin.
Sample E-1-13.0 g/L acrylic copolymer B and 3.0 g/L acrylic copolymer C.

In each case, Nylon 6 substrate was immersed in the stain resist solution to a pickup of about 350%, then steamed for 3 minutes, followed by light rinse and drying, ready for testing.

The test methods were carried out as described above and the results are set out in Table 1:

TABLE 1

| PRODUCT | IS | WS | ID | LD |
|---|---|---|---|---|
| SAMPLE A | 7–8 | 6–7 | 4–5 | 4–5 |
| SAMPLE B | 6 | 4 | 4–5 | 4–5 |
| SAMPLE C | 4 | 3 | 4–5 | 4–5 |
| SAMPLE D | 7 | 5 | 3–4 | 3–4 |
| SAMPLE E | 8 | 7 | 4–5 | 4–5 |
| SAMPLE E-1 | 8 | 7 | 4–5 | 4–5 |

Example 2

2. Test on Nylon 66

A treatment bath was adjusted to pH 2 with sulfamic acid and 3 g/L of magnesium sulfate was added whenever phenolic resin was added.

Sample F 6.6 g/L of acrylic copolymer B and 1.4 g/L acrylic copolymer A

Sample G 8 g/L of Leukotan 970

Sample H 4.8 g/L Leukotan 970

Sample I 6.7 g/L Leukotan 970 1.3 g/L Alguard NS

Sample J 5.8 g/L Acrylic copolymer B 1.7 g/L Acrylic copolymer A 0.5 g/L Resol resin Sample K 6.6 g/L acrylic copolymer B and 1.4 g/L acrylic copolymer C.

The Nylon 66 substrate was immersed in the stain resist solution to pick up around 350% then steamed for approximately 3 minutes followed by a light rinse and dried, ready for testing. The test results are set out in Table 2.

TABLE 2

| PRODUCT | IS | WS | ID | LD |
|---|---|---|---|---|
| SAMPLE F | 8 | 6 | 4–5 | 4–1 |
| SAMPLE G | 7 | 5 | 4–5 | 4 |
| SAMPLE H | 7 | 4 | 4–5 | 4–5 |
| SAMPLE I | 8 | 7 | 4 | 4–1 |
| SAMPLE J | 8 | 6–7 | 4 | 4 |
| SAMPLE K | 7–8 | 6 | 4–5 | 4 |

From the data in Table 1, it can be seen that the Leukotan 970 alone and in combination with the phenolic resin did not give optimum results on the Nylon 6.

However, the acrylic copolymers A and B together or in combination with the Resol resin produced excellent results.

From the data in Table 2, it can be seen that the Leukotan 970 and the Phenolic resin produced similar results to the combination of this invention (the acrylic copolymers A and B plus the resol resin) with respect to light fastness and yellowing.

It is well known to those skilled in the art that Nylon 66 is comparatively easier to render stain resistant than is Nylon 6.

Prior to the present invention, a stainblocker was not available having a maximum stain resist and durability on Nylon 6 plus superior light fastness.

The combination of acrylic copolymer A or C with B improved the staining problem on Nylon 6, and in addition provided excellent results in the durability to wet cleaning process and light fastness.

In addition to those achievements the excellent results of the light fastness and the non-yellowing of Nylon 6 with this invention, solved the traditional problem of Nylon 6.

The acrylic polymer B was tested alone on Nylon 6 and 66 and also produced very good results especially in the light fastness and the discoloration.

I claim:

1. A fibrous polyamide substrate having resistance to staining by acid colorants, comprising:

a fibrous polyamide substrate having applied there to a combination of:

a) a semi-soluble or insoluble ethyl methacrylate polymer having a weight average molecular weight of 100,000 to 500,000 and a number average molecular weight of 25,000 to 100,000; and b) a soluble or semi-soluble methacrylic acid polymer having a weight average molecular weight of 100,000 to 500,000 and a number average molecular weight of 50,000 to 100,000.

2. A substrate according to claim 1 wherein said combination further includes a partially sulfonated resol resin.

3. A substrate of claim 2 wherein said partially sulfonated resol resin comprises a sulfonated condensation product of a phenol with an aldehyde at an alkaline pH.

4. A substrate of claim 1, wherein a) is an ethylmethacrylate homopolymer.

5. A substrate of claim 1 wherein a) is an ethyl methacrylate copolymer.

6. A substrate of claim 5, wherein a) is a copolymer of ethylmethacrylate and methacrylic acid.

7. A substrate of claim 1 wherein polymer a) is a copolymer of ethylmethacrylate and one or more comonomers selected from ethylacrylate, methacrylate, methylmethacrylate, methacrylic acid, butylmethacrylate, isobutyl methacrylate or 2-ethylhexylmethacrylate.

8. A substrate of claim 1 wherein polymer b) is a copolymer of methacrylic acid and a comonomer selected from ethylacrylate, 2-ethylhexylmethacrylate, ethyl methacrylate, methylmethacrylate, butyl methacrylate or isobutyl methacrylate.

9. A substrate of claim 1 wherein said polymer a) has a weight average molecular weight of 100,000 to 170,000 and a number average molecular weight of 30,000 to 60,000.

10. A substrate of claim 1 wherein said polymer b) has a weight average molecular weight of 150,000 to 250,000 and a number average molecular weight of 60,000 to 75,000.

11. A substrate of claim 1 wherein said substrate is Nylon 66 and said combination comprises a partially sulfonated resol resin in an amount of from 0% to 2%, by weight, based on the weight of substrate; said polymer a) is present in an amount of at least about 0.02 weight percent, based on the weight of substrate, and said polymer b) is present in an amount of at least 0.04 weight percent, based on the weight of substrate.

12. A substrate of claim 1 wherein said substrate is Nylon 6 and said combination comprises a partially sulfonated resol resin in an amount between 0% and 4%, by weight, based on the weight of substrate, said polymer a) is present in an amount of at least about 0.04 weight percent based on the weight of substrate and said polymer b) is present in an amount of at least about 0.08 weight percent, based on the weight of substrate.

13. A fibrous polyamide substrate having resistance to staining by acid colorants, said fibrous polyamide substrate having applied thereto a combination of:

a) a polymer selected from semi-soluble and insoluble homopolymers of ethylmethacrylate and semi-soluble or insoluble copolymers of ethylmethacrylate and at least one comonomer selected from ethylacrylate, methylacrylate, methylmethacrylate, methacrylic acid, butylmethacrylate, isobutylmethacrylate or 2-ethylhexylmethacrylate; said polymer having a weight average molecular weight of 100,000 to 500,000 and a number average molecular weight of 25,000 to 100,000;

b) a polymer selected from soluble or semi-soluble homopolymers of methacrylic acid, and soluble or semi-soluble copolymers of methacrylic acid and at least one comonomer selected from ethylacrylate, 2-ethylhexylmethacrylate, ethyl methacrylate, methylmethacrylate, butylmethacrylate or isobutyl methacrylate; said polymer having a weight average molecular weight of 100,000 to 500,000 and a number average molecular weight of 50,000 to 100,000; and c) a partially sulfonated resol resin.

14. A substrate of claim 13, wherein said substrate is Nylon 66 and said combination comprises a partially sulfonated resol resin in an amount of from 0% to 2%, by weight, based on the weight of substrate; said polymer a) is present in an amount of at least about 0.02 weight percent, based on the weight of substrate, and said polymer b) is present in an amount of at least 0.04 weight percent, based on the weight of substrate.

15. A substrate of claim 13 wherein said substrate is Nylon 6 and said combination comprises a partially sulfonated resol resin in an amount between 0% and 4%, by weight, based on the weight of substrate, said polymer a) is present in an amount of at least about 0.04 weight percent based on the weight of substrate and said polymer b) is present in an amount of at least about 0.08 weight percent, based on the weight of substrate.

16. A substrate of claim 13, wherein a) is a homopolymer of ethylmethacrylate.

17. A substrate of claim 13, wherein a) is a copolymer of ethylmethacrylate and methacrylic acid.

18. A method of imparting stain resistance to acid colorants, to a fibrous polyamide substrate comprising:

contacting said fibrous polyamide substrate with an aqueous formulation comprising in an aqueous vehicle a) a semi-soluble or insoluble ethylmethylacrylate polymer having a weight average molecular weight of 100,000 to 500,000 and a number average molecular weight of 25,000 to 100,000, and b) a soluble or semi-soluble methacrylic acid polymer having a weight average molecular weight of 100,000 to 500,000 and a number average molecular weight of 50,000 to 100,000.

19. A method according to claim 18, wherein said formulation further includes a partially sulfonated resol resin.

20. A method according to claim 19, wherein said polymer a) has a weight average molecular weight of 100,000 to 170,000 and a number average weight of 30,000 to 60,000; and polymer b) has a weight average molecular weight of 150,000 to 250,000 and a number average weight of 60,000 to 75,000.

21. A method according to claim 20, wherein a) is a homopolymer of ethylmethacrylate.

22. A method according to claim 20, wherein a) is a copolymer of ethylmethacrylate and methacrylic acid.

* * * * *